US008256616B2

(12) United States Patent
Eilert

(10) Patent No.: US 8,256,616 B2
(45) Date of Patent: Sep. 4, 2012

(54) PACK FOR CONTAINING HYGIENE PRODUCTS

(75) Inventor: Diana Eilert, Mannheim (DE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 12/669,879

(22) PCT Filed: Jul. 14, 2008

(86) PCT No.: PCT/EP2008/059161

§ 371 (c)(1),
(2), (4) Date: Mar. 10, 2010

(87) PCT Pub. No.: WO2009/013164

PCT Pub. Date: Jan. 29, 2009

(65) Prior Publication Data

US 2010/0181219 A1 Jul. 22, 2010

(30) Foreign Application Priority Data

Jul. 20, 2007 (EP) ..... 07014283

(51) Int. Cl.
*B65D 85/00* (2006.01)

(52) U.S. Cl. ..... 206/391; 206/494; 383/207

(58) Field of Classification Search ..... 206/389, 206/581, 391, 394, 390, 410, 497, 494, 440, 206/812; 229/87.05, 87.01, 103.3; 383/200, 383/207

See application file for complete search history.

(56) References Cited

U.S. PATENT DOCUMENTS

| | | | | | |
|---|---|---|---|---|---|
| 1,992,184 | A * | 2/1935 | Burke | 229/87.05 |
| 2,665,834 | A * | 1/1954 | Anglada | 229/87.05 |
| 2,699,285 | A * | 1/1955 | Bell et al. | 229/87.05 |
| 4,934,535 | A * | 6/1990 | Muckenfuhs et al. | 206/494 |
| 5,129,518 | A * | 7/1992 | Tanaka et al. | 206/497 |
| 5,423,423 | A * | 6/1995 | Sato et al. | 206/387.1 |
| 5,560,538 | A * | 10/1996 | Sato et al. | 229/87.05 |
| 6,006,907 | A * | 12/1999 | Sato et al. | 206/387.1 |
| 6,368,113 | B1 | 4/2002 | Unger et al. | |
| 7,241,066 | B1 * | 7/2007 | Rosen et al. | 401/183 |
| 2003/0106825 | A1 | 6/2003 | Molina et al. | |
| 2006/0096879 | A1 | 5/2006 | Zander et al. | |

FOREIGN PATENT DOCUMENTS

| | | |
|---|---|---|
| DE | 4121914 | 1/1992 |
| EP | 0454541 | 10/1991 |
| EP | 1405802 | 4/2004 |

OTHER PUBLICATIONS

International Search Report dated Oct. 16, 2008 in PCT application.

* cited by examiner

*Primary Examiner* — Steven A. Reynolds
(74) *Attorney, Agent, or Firm* — Young & Thompson

(57) ABSTRACT

A pack (1) for containing at least two hygiene products (100), in particular at least two uncompressed toilet paper rolls, kitchen paper rolls, household towels, individual packs of handkerchiefs or other tissue paper products. The pack includes a packaging (2) for containing the hygiene products (100), the packaging (2) being folded over and joined in an overlap (264) in a bottom wall (26) of the packaging (2); a side wall (22) extending substantially in an angle, preferably by 90° or 60°, with respect to the bottom wall (26) of the packaging (2); a single line of weakness (3) extending in a portion of the side wall (22), a portion of the bottom wall (26) and a portion of the overlap (264).

18 Claims, 2 Drawing Sheets

PACK FOR CONTAINING HYGIENE PRODUCTS

The present invention relates to packs for containing at least two hygiene products, in particular for containing at least two toilet paper rolls, kitchen paper rolls, household towel rolls, individual packs of handkerchiefs or other tissue paper products, in particular uncompressed hygiene products.

TECHNICAL FIELD AND PRIOR ART

It is known to fill hygiene products for distribution, presentation and for retailing to the end customer into packs, in particular into flexible packs made from a plastic film material. The packs are usually made such that an appropriate number of hygiene products can be retailed to the customer. For example, rolls of toilet paper are often supplied to the end customer in packs of 1×2, 2×2, 2×5, 2×4, 3×3, 4×3 or 4×5 rolls. However, other configurations for containing up to 25 toilet paper rolls are also widely used. Typically, the rolls are arranged in these packs in single, double or triple layer arrangements such that the respective winding axes of the toilet paper rolls of a layer are situated in the plane defined by the layer and the winding axes are substantially parallel to one another. In other typical packs, the winding axes of the toilet paper rolls of one layer are parallel to one another but extend substantially perpendicular to the plane defined by the layer such that the winding axes represent the nodes of a substantially perpendicular grid.

Packs of this kind are also known in the field of other hygiene products that are wound onto rolls, in particular kitchen towels and household towels. Due to the greater axial extension of these rolls, the rolls are typically arranged parallel to one another, particularly in single layer or double layer arrangements. In other words, packs of 1×2, 1×3, 1×4, 2×2 or 2×4 kitchen towels or household towels are customary. However, other configurations for containing up to 16 rolls of kitchen towels or household towels are also widely used.

Handkerchiefs, in particular tissue handkerchiefs, are typically distributed in small flexible packs containing five to ten single handkerchiefs. However, other numbers between three and 25 single handkerchiefs, and even higher numbers of handkerchiefs, are also used. These small packs, referred to as individual packs in the following, are very convenient for the customer to use and to carry. However, at least in supermarkets and retail markets the individual packs of handkerchiefs are not sold singly, but in packs of a plurality of individual packs. One example of an individual pack used for tissue handkerchiefs is disclosed in DE 41 21 914 A1.

The pack sizes of individual packs of handkerchiefs retailed to the end customer are typically in arrangements of 2×2, 2×5, 2×3×5 or other typical configurations, depending on the outer appearance the tissue handkerchief manufacturer aims to achieve. However, it is customary in these distribution packs to fill at least two layers of individual packs of handkerchiefs on top of one another. Three and more layers are also widely used.

The packaging material of these packs is usually made of a plastic film material, in particular a substantially transparent plastic film material, on which product designations, trade names, trademark designations, decorations or the like can be printed.

All the packs mentioned above have in common that they are used to distribute a plurality of hygiene products, in particular rolls of toilet paper, rolls of household towels, kitchen towels or individual handkerchief packs. The packs used for distribution and for retailing the hygiene products need to be opened by the end consumer. Typically, the end consumer opens the distribution package by ripping/tearing it open wherein the end customer typically uses its hands or fingers to pierce through the plastic film material at a random position, then tears the pack open and withdraws the intended number of hygiene products. This tearing open results in a pack that is untidily torn open at a random point and in which the hygiene products are scattered around in an untidy manner. In many cases, the package even rips apart completely, bearing the risk that the hygiene products fall out and possibly come into contact with the floor with the inherent risk of contamination. In many cases, the packaging is also torn open in the region of lettering or printing and, thus, any product information or information with respect to expiry dates is lost.

Furthermore, it takes the end customer a great deal of force to use the fingers to pierce the film material at a random point and a considerable force is necessary to tear open the pack, which might be a problem, in particular for elderly people.

US 2006/0096879 A1 relates to a dispensing aid for facilitating the removal of individual products from a compressed pack. The pack has gussets on its upper end and on its lower end and a perforation line extending from the upper side to the lower side of the pack such that an entire wall of the pack can be opened.

US 2003/0106825 A1 relates to a pack with similar features as the one described above.

One disadvantage of the packs mentioned above is that, in order to withdraw individual hygiene products from the packs, a complete wall of the pack needs to be opened along the perforation such that the hygiene products remaining in the opened pack are in danger of being contaminated or falling out of the pack. Furthermore, opening the pack can be difficult as different sections of a wall extending in a single plane need to be gripped and torn apart.

SUMMARY OF THE INVENTION

On the basis of the above, one object of the present invention is the provision of a pack for at least two hygiene products which can be easily opened and which prevents hygiene products from falling out of the opened pack.

According to the present disclosure, the pack for containing at least two hygiene products, in particular at least two uncompressed toilet paper rolls, kitchen paper rolls, household towels, individual packs of handkerchiefs or other tissue paper products, comprises a packaging for containing the hygiene products, the packaging being folded over and joined in an overlap in a bottom wall of the packaging. Furthermore, a side wall is provided which extends substantially in an angle, preferably by 90° or 60°, with respect to the bottom wall of the packaging, and a single line of weakness extends in a portion of the side wall, a portion of the bottom wall and a portion of the overlap.

The feature that the line of weakness extends in a portion of the bottom wall, a portion of the overlap and a portion of the side wall enables opening the pack in the corner thus defined. In other words, an opening for withdrawing hygiene products from the pack can be introduced into the pack in a corner of the pack, preferably of a size such that only one hygiene product can be withdrawn through the opening at a time. The hygiene products remaining in the pack are thus safe from falling out of the pack as the opening is too small and does not extend over the whole side wall or whole bottom wall of the pack. Additionally, the side wall and the bottom wall remain structurally substantially intact, leading also to a slight self-closing effect of the pack.

Furthermore, as the packaging of the pack has an overlap in the bottom wall, the resulting "ears" can be used as tabs or handles to pull open the pack along the single line of weakness. It is to be noted that only a single line of weakness, which extends in a portion of the side wall as well as in a portion of the bottom wall, including a portion of the overlap, needs to be provided for the opening mechanism. It is also important for the invention that indeed only a single line of weakness is provided in order to achieve the beneficial self-closing effect and the avoidance of hygiene products falling out of the opened pack.

In particular, in a bottom fold packaging, which is a customary packaging for packs for hygiene products, in particular for toilet paper rolls, the opening mechanism as explained above is a simple yet effective way of providing an opening mechanism that is easy to use, prevents hygiene products remaining in the pack from falling out and can easily be opened without the need of supplying additional packaging or opening features. The main feature that has to be provided is the single line of weakness in the readily folded packaging, extending in two walls and the overlap.

Even though reference is made to a "bottom wall" and a "side wall" of the packaging, it is to be understood that the terms "side" and "bottom" are not considered limiting and any other combination of walls can be used, provided a first wall comprises the overlap and, a second wall extends from the first wall in an angle, preferably by 90° or 60°.

Throughout the description, the term "packaging" will be understood to embrace at least bags and wrappers. Bags provide a volume into which the hygiene products can be filled. Bags are typically pre-manufactured by using a tube-like film material, a folded film material or two webs of film material, the respective layers of the film material being joined together on an appropriate number of edges in order to form the bag, leaving open only one single side of the pre-manufactured bag. In contrast, wrappers are provided in the form of a single layer of flat film material which is wrapped around the already arranged hygiene products and is then attached to itself in order to close in the hygiene products.

As a material for the film material for the packaging, in particular for a bag or a wrapper, it is preferred using polypropylene films, polyethylene films, starch based films, biodegradable films and/or material mixtures thereof. In other embodiments it is envisaged using a paper material as the packaging. A shrink film material may also be used. The packaging material may be provided in the form of different layers of material, in particular as a multi-layer film and/or a laminate.

The hygiene products that can be contained in the pack include, but are not limited to, toilet paper rolls, kitchen paper rolls, household towel rolls, individual packs of handkerchiefs, napkins, facials, hand wiping towels, folded and unfolded tissue paper, object wiping rolls and any other suitable hygiene product for personal hygiene or for object wiping and cleaning. It will be appreciated that also the comparatively big rolls and packs used in public or professional dispensers may be the hygiene products contained in the pack. In a preferred embodiment, the hygiene products themselves are also contained in a individual packaging, in particular in the form of individual rolls wrapped in paper or in a plastic film material.

The single line of weakness may be provided in the form of a perforation line which may be provided in the form of circular, triangular, rectangular, oval and/or wavy openings.

In a preferred embodiment a first flap resulting from the material of a first main wall and a second flap of material resulting from a second main wall are folded on top of one another and joined in the bottom wall, resulting in the overlap. This appears to be the typical arrangement of a bottom fold packaging but is advantageous in combination with the single line of weakness provided in a portion of the bottom wall and the overlap. Preferably, the flaps form edges resulting in spaces, in particular gussets, between the edges and the bottom wall. The edges, or rather the material extending there from, can be gripped by a customer in order to open the pack along the line of weakness provided.

Preferably, the single line of weakness is composed of a first section situated in the side wall, a second section situated in the bottom wall and a third section situated in the overlap, and is provided as a continuous line of weakness.

In a preferred embodiment, the line of weakness extends in the side wall approximately by ⅓, ½ or ⅔ of the length of the side wall. In another preferred embodiment, the line of weakness extends in the bottom wall approximately by ⅓, ½ or ⅔ of the height of the bottom wall. In these embodiments, the provision of the single line of weakness in the aforementioned lengths results in an opening that is situated in a corner of the pack and that is arranged such that the hygiene products cannot fall out of the pack in the opened state.

Preferably, the pack is a distribution pack that can be distributed to the end consumer. In another preferred embodiment, a re-closable tab is provided to re-close the pack after it has been opened in order to prevent hygiene products from falling out of the opened pack. Preferably, the re-closable tab is a re-closable stripe of adhesive material or a re-closable stripe of mechanically attachable material, such as Velcro, a button or a snap fastener, in order to re-close the opening section after opening. Accordingly, the pack can be used not only as a distribution pack but also as a pack for storing the hygiene products, even after the first hygiene products have been withdrawn from the pack.

In order to allow for an easy opening, an indication of the opening mechanism can be colour-coded on the packaging.

BRIEF DESCRIPTION OF THE FIGURES

The invention will be described in more detail below with reference to the drawings, in which.

DETAILED DESCRIPTION OF THE FIGURES

Figure 1:
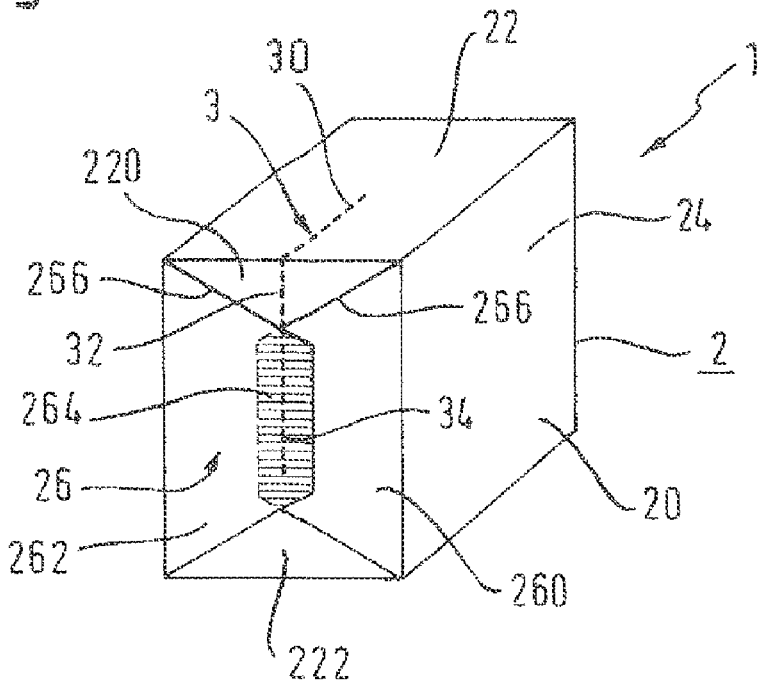
FIG. 1 is a schematic perspective view of the pack according to a first embodiment of the invention.

In the following description of the respective embodiments, the same reference numerals are used for the same or similar features and a iterated description of the respective features is not provided in order to improve the intelligibility of the disclosure.

FIG. 1 shows a schematic perspective view of a pack 1 for hygiene products in a first embodiment. The pack 1 has a main wall 20, a side wall 22, a top wall 24, which is not visible in FIG. 1, and a bottom wall 26. It is apparent that the top wall 24 and the bottom wall 26 are situated opposite to one another but are basically parallel to one another. The main wall 20 as well as the side wall 22 have their respective counterparts in opposite and parallel walls. The bottom wall 26 and the side wall 22 are situated with respect to one another substantially at an angle of 90°. However, it is envisaged that in other preferred embodiments the bottom wall and the side wall are situated with respect to one another by other angles, e.g. substantially by 60°.

The bottom wall 26 of the pack 1 shows a so-called bottom fold packaging, in which the foil material, which is used for the pack 1, is folded over in order to close the pack. The principle for folding over is that the material extending from the side walls 22 is folded into the center of the bottom 26 in a first step and then the resulting flaps 260, 262, which basically extend from the main walls 20, are also folded into the center. In the overlap 264 of the two flaps 260 and 262, the two flaps 260 and 262 are joined to one another, preferably by gluing or (heat-) welding.

One characteristic feature of such a bottom fold back is that the two flaps 260 and 262 are only glued to one another in the overlap 264 such that the two flaps 260 and 262 can be slightly lifted off from the material 220 and 222 resulting from the folded-in side panels.

In an alternative embodiment, the overlap 264 is also completely welded to the material resulting from the folded-in side panels, namely to the material sections 220 and 222.

Nevertheless, in both embodiments mentioned above, the edges 266 of the first flap 260 and the second flap 262 are relatively freely accessible. In particular, it is possible for an end user to reach into a space between the flaps 260, 262 and the remaining material 220, 222 such that the material of the flaps 260, 262 can be gripped at the edges 266.

In the pack 1 shown in FIG. 1, a single line of weakness in the form of the perforation 3 is provided, which comprises basically three different sections, namely a first section 30 extending in the side wall 22, a second section 32 extending in the bottom wall 26 and a third section 34 extending into the overlap 264 between the flaps 260, 262.

The single perforation 3 does not extend all over the respective walls 22, 26 but extends only in a portion of the length (width) of the side wall 22 as well as the bottom wall 26 and the overlap 264. In the embodiment shown in FIG. 1, the first section 30 of the perforation, which extends in the side wall 22, only extends approximately along one third of the length of the side wall 22. In the bottom wall 26, the perforations 32, 34 extend basically towards the middle of the bottom wall 26.

Accordingly, when an end customer grips the edges 266 of the two flaps 260, 262 and pulls them apart basically along the plane of the bottom wall 26, the pack 1 tears apart along the perforation 3. It is, thus, an easy task for an end user to open the pack 1. Due to the reduced length of the perforation 3, a complete destruction of the pack 1 can be avoided and its structural integrity can be maintained.

It is also easy for the end customer to open the pack 1 as the edges 266 produce a pocket-like gripping means, which can easily be gripped by an end user.

The perforation 3 is to be chosen appropriately such that the force necessary to open the pack along the perforation 3 is reasonable.

In an embodiment not shown in the figures, an indication of the opening mechanism is colour coded on the packaging 2 in order to enable an easy opening. Such a colour coding may be achieved e.g. by printing icons on the packaging 2.

Figure 2:
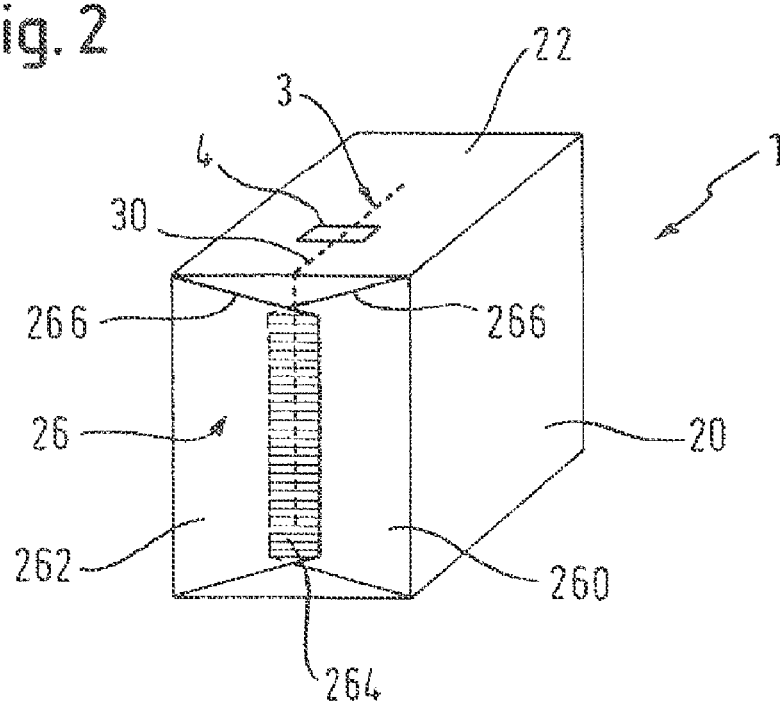
FIG. 2 is another schematic perspective view of the pack according to a second embodiment of the invention.

FIG. 2 shows a pack 1 in a different embodiment. The basic structure, however, is identical to that shown in FIG. 1. The main differences are in the extension of the overlap 264, which is considerably larger in this pack. This results, however, mainly from the outer dimensions, in particular from the dimensions of the width and length of the bottom wall 26 of the pack 1 which results in a differently shaped overlap 264. Furthermore, the single perforation 3 extends in this embodiment further into the side wall 22 and further into the overlapping and gluing section 264, in particular approximately ⅞ of each of the walls. However, this extension is not regarded as extending through the whole wall 22 or 26 as the structural integrity of the respective walls, in particular the side wall 22 and the bottom wall 26, remains intact.

The edges 266 in the two flaps 260, 262 are also present and serve as the gripping means or "ears" of the bottom wall 26 of the pack 1, which can be gripped by the end user in order to open the pack 1 along the perforation line 3.

A re-closable tab 4 is provided in the side wall 22 and extends across the perforation line 30. The re-closable tab 4 enables a re-closing of the pack 1 after it has been opened.

Figure 3:
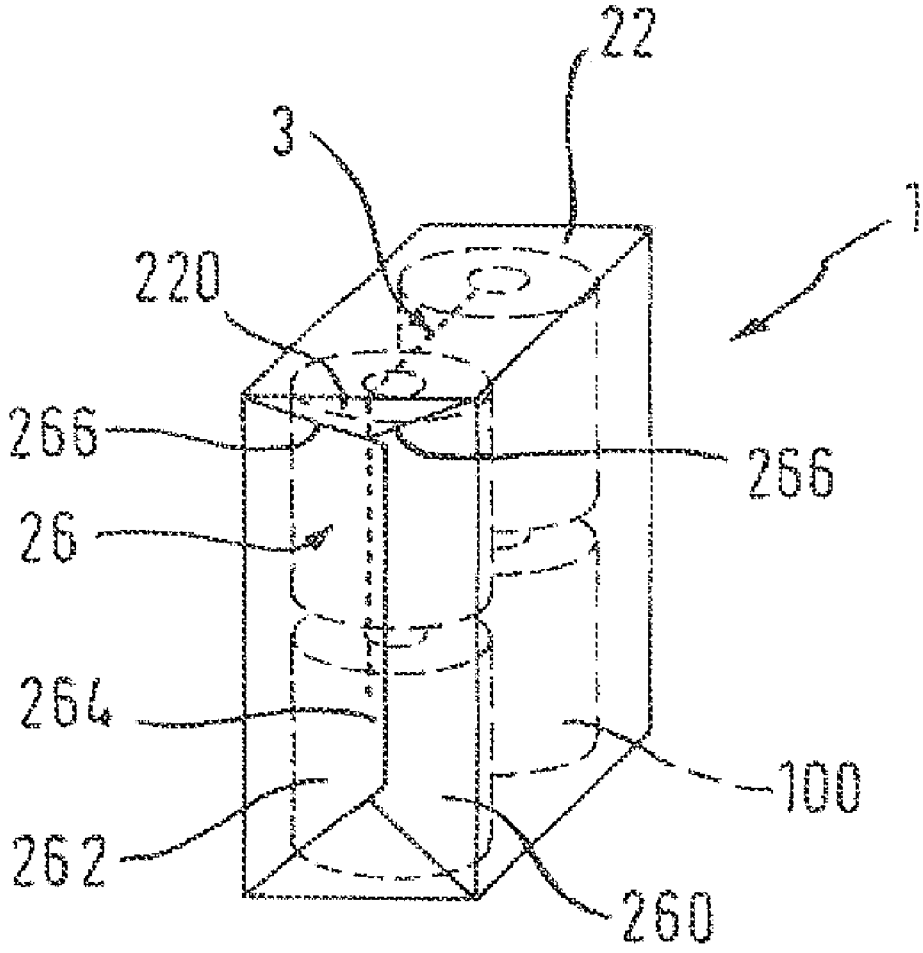
FIG. 3 is another schematic perspective view of a third embodiment of the invention.

FIG. 3 shows yet another embodiment of the pack 1 according to the present invention. Here, two flaps 260 and 262 are attached to one another in a gluing section 264 such that they stick out a little from the bottom wall 26. In other words, in a plane view of the side panel 22, the two flaps 260, 262 would appear to enclose a triangle. Accordingly, the pockets defined by the edges 266 and the material 220 of the bottom wall 26 are slightly larger than in the embodiments shown in FIGS. 1 and 2. Thus, it might be even more intuitive for an end user to use these edges 266 or "ears" for opening the pack. The perforation extends in this embodiment from the middle of the side wall 22 towards the middle of the bottom wall 26.

In this embodiment, hygiene products in the form of multiple toilet paper rolls 100 are schematically shown to be situated in the pack 1.

For this specific form of the pack to work properly, it is important that the perforation 3 extends from the side panel 22 continuously into the bottom wall 26 and, in particular, continuously from the material 220 in the bottom wall 26 into the overlap 264 in which the two flaps 260 and 262 are joined to one another.

While only preferred embodiments have been described in terms of particular variations and illustrative figures, those of ordinary skill in the art will recognize that the invention is not limited to the variations or figures described. Therefore, it will be understood that various modifications, variations, changes and adaptations will be apparent to those of ordinary skill in the art without departing from the scope of the appended claims and it is the intent that this patent will cover those modifications, variations, changes and adaptations, as well as equivalents to the subject-matter found in the claims.

The invention claimed is:

1. A pack for containing at least two hygiene products selected from the group consisting of uncompressed toilet paper rolls, kitchen paper rolls, household towels, individual packs of handkerchiefs and other tissue paper products, the pack comprising:

a packaging for containing the hygiene products, the packaging including first and second main walls that include respective first and second flaps which are folded over and joined in an overlap in a bottom wall of the packaging;

a side wall extending substantially at an angle with respect to the bottom wall of the packaging, material from the side wall being folded over into a center of the bottom wall of the packaging under the overlap, spaces being between the folded over material from the side wall and the first and second flaps such that edges of the first and second flaps form ears that can be gripped in order to open the pack along a single perforation line of weakness;

wherein the single perforation line of weakness extends continuously from the side wall into the bottom wall and the overlap, the single perforation line of weakness being a contiguous line having only a first section in the side wall, only a second section in the bottom wall and only a third section in the overlap, the packaging is configured such that when the first and second flaps are pulled back the pack tears apart along the single perforation, and the line of weakness creates an opening in the side wall while leaving the main walls intact.

2. The pack according to claim 1, wherein the line of weakness extends in the side wall approximately by ⅓, ½ or ⅔ of the length of the side wall.

3. The pack according to claim 1, wherein the line of weakness extends in the bottom wall approximately by ⅓,½ or ⅔ of the height of the bottom wall.

4. The pack according to claim 1, wherein the pack is a distribution pack.

5. The pack according to claim 1, wherein a re-closable tab, or a re-closable stripe of adhesive material or a re-closable stripe of mechanically re-closable material, including hook and loop, a button or a snap fastener, is provided in order to re-close an opening section after opening.

6. The pack according to claim 1, wherein an indication of an opening mechanism is colour coded on the packaging.

7. The pack according to claim 1, wherein the packaging is made from a film material selected from the group consisting of polypropylene films, polyethylene films, starch based films, biodegradable films, shrinkable films and/or mixtures thereof, and/or a paper material, in the form of different layers of material, as a multi-layer film and/or a laminate.

8. The pack according to claim 1, wherein the hygiene products include toilet paper rolls, kitchen paper rolls, household towel rolls, individual packs of handkerchiefs, napkins, facials, hand wiping towels, folded and unfolded tissue paper, object wiping rolls and any other suitable hygiene products for personal hygiene, for object wiping and/or cleaning purposes.

9. The pack according to claim 1, wherein the spaces formed between the edges and the bottom wall are gussets.

10. The pack according to claim 1, wherein the side wall extends at an angle of 90° or 60° with respect to the bottom wall of the packaging.

11. A pack for containing at least two hygiene products, the pack comprising:

a packaging for containing the hygiene products, the packaging including first and second main walls that include respective first and second flaps which are folded over and joined in an overlap in a bottom wall of the packaging;

a side wall extending substantially at an angle with respect to the bottom wall of the packaging, material from the side wall being folded over into a center of the bottom wall of the packaging under the overlap, spaces being between the folded over material from the side wall and the first and second flaps such that edges of the first and second flaps form ears that can be gripped in order to open the pack along a single perforation line of weakness;

wherein the single perforation line of weakness extends continuously from the side wall into the bottom wall and the overlap, the single perforation line of weakness being a contiguous line having only a first section in the side wall, only a second section in the bottom wall and only a third section in the overlap, the packaging is configured such that when the first and second flaps are pulled back the pack tears apart along the single perforation, and the line of weakness creates an opening in the side wall while leaving the main walls intact.

12. The pack according to claim 11, wherein the line of weakness extends in the side wall approximately by ⅓, ½ or ⅔ of the length of the side wall.

13. The pack according to claim 11, wherein the line of weakness extends in the bottom wall approximately by ⅓, ½ or ⅔ of the height of the bottom wall.

14. The pack according to claim 11, wherein the pack is a distribution pack.

15. The pack according to claim 11, wherein a re-closable tab, or a re-closable stripe of adhesive material or a re-closable stripe of mechanically re-closable material, such as hook and loop, a button or a snap fastener, is provided in order to re-close an opening section after opening.

16. The pack according to claim 11, wherein an indication of an opening mechanism is colour coded on the packaging.

17. The pack according to claim 11, wherein the packaging is made from a film material selected from the group consisting of polypropylene films, polyethylene films, starch based films, biodegradable films, shrinkable films and/or mixtures thereof, and/or a paper material, in the form of different layers of material, as a multi-layer film and/or a laminate.

18. The pack according to claim 11, wherein the hygiene products include toilet paper rolls, kitchen paper rolls, household towel rolls, individual packs of handkerchiefs, napkins, facials, hand wiping towels, folded and unfolded tissue paper, object wiping rolls and any other suitable hygiene products for personal hygiene, for object wiping and/or cleaning purposes.

* * * * *